US008249439B2

(12) United States Patent
Heinrich et al.

(10) Patent No.: US 8,249,439 B2
(45) Date of Patent: Aug. 21, 2012

(54) HIGH-PRESSURE GAS HEATING DEVICE

(75) Inventors: Peter Heinrich, Germering (DE); Heinrich Kreye, Hamburg (DE); Tobias Schmidt, Eslohe (DE)

(73) Assignee: Linde Aktiengesellschaft, Munich (DE)

( * ) Notice: Subject to any disclaimer, the term of this patent is extended or adjusted under 35 U.S.C. 154(b) by 982 days.

(21) Appl. No.: 12/091,942

(22) PCT Filed: Nov. 9, 2006

(86) PCT No.: PCT/EP2006/010759

§ 371 (c)(1),
(2), (4) Date: Oct. 13, 2008

(87) PCT Pub. No.: WO2007/054313

PCT Pub. Date: May 18, 2007

(65) Prior Publication Data

US 2009/0226156 A1 Sep. 10, 2009

(30) Foreign Application Priority Data

Nov. 10, 2005 (DE) ..... 10 2005 053 731
Jan. 5, 2006 (EP) ..... 06000207

(51) Int. Cl.
*F24H 1/10* (2006.01)
*H05B 3/78* (2006.01)

(52) U.S. Cl. ..... 392/488; 392/465; 392/485; 392/491; 392/493

(58) Field of Classification Search ..... 392/465, 392/485, 488, 491, 493
See application file for complete search history.

(56) References Cited

U.S. PATENT DOCUMENTS

| | | | | | |
|---|---|---|---|---|---|
| 427,574 | A | * | 5/1890 | Howard | 392/350 |
| 1,869,623 | A | | 8/1932 | Rubini et al. | |
| 3,054,664 | A | * | 9/1962 | Purse | 422/173 |
| 3,149,925 | A | * | 9/1964 | Scheitlin | 422/176 |
| 3,695,851 | A | * | 10/1972 | Perga | 22/179 |
| 3,701,823 | A | * | 10/1972 | Hardison | 23/213.7 |
| 3,768,982 | A | * | 10/1973 | Kitzner et al. | 422/174 |
| 3,801,289 | A | * | 4/1974 | Wiley | 422/179 |
| 3,841,839 | A | * | 10/1974 | Wiley | 422/179 |
| 4,002,433 | A | * | 1/1977 | Oser | 422/176 |
| 4,490,333 | A | | 12/1984 | Humphries et al. | |
| 4,775,518 | A | * | 10/1988 | Abthoff et al. | 422/179 |
| 4,976,929 | A | * | 12/1990 | Cornelison et al. | 422/174 |
| 5,281,399 | A | * | 1/1994 | Rittler | 422/179 |
| 5,457,945 | A | * | 10/1995 | Adiletta | 55/301 |
| 5,465,573 | A | * | 11/1995 | Abe et al. | 60/274 |
| 5,482,681 | A | * | 1/1996 | Sager, Jr. | 422/180 |
| 5,569,455 | A | * | 10/1996 | Fukui et al. | 422/174 |
| 5,963,709 | A | | 10/1999 | Staples et al. | |

(Continued)

FOREIGN PATENT DOCUMENTS

DE 511895 11/1930

(Continued)

*Primary Examiner* — Thor Campbell
(74) *Attorney, Agent, or Firm* — Philip H. Von Neida

(57) ABSTRACT

A high-pressure gas-heating device has a pressurized container (1) carrying a gas, a heating element (3) arranged in the pressurized container (1), and an insulation (2). The insulation (2) is arranged on the interior wall of the pressurized container (1). The pressurized container (1) is designed for pressures of to 100 bar, and at least one flow distributor element (5) is arranged in an inflow area of the pressurized container (1) to distribute the inflowing gas over the entire width of the heating element (3).

18 Claims, 2 Drawing Sheets

U.S. PATENT DOCUMENTS

| | | | | |
|---|---|---|---|---|
| 7,722,828 | B2 * | 5/2010 | Zuberi et al. | 422/177 |
| 2002/0189097 | A1 * | 12/2002 | Collins et al. | 29/890 |
| 2004/0050618 | A1 * | 3/2004 | Marocco | 181/248 |
| 2005/0279571 | A1 * | 12/2005 | Marocco | 181/270 |
| 2007/0221746 | A1 * | 9/2007 | Heinrich et al. | 239/135 |
| 2011/0041945 | A1 * | 2/2011 | Ohmura et al. | 138/140 |

FOREIGN PATENT DOCUMENTS

| | | |
|---|---|---|
| EP | 0 099 825 | 10/1985 |
| FR | 2 568 672 | 2/1986 |

* cited by examiner

HIGH-PRESSURE GAS HEATING DEVICE

CROSS REFERENCE TO RELATED APPLICATIONS

This application claims priority from International Patent Application PCT/EP2006/010759, filed 9 Nov. 2006, which claims priority from German Patent Application No. 1020050537, filed 10 Nov. 2005, and European Patent Application No. 06000207.8 with a filing date of 1 May 2006.

BACKGROUND OF THE INVENTION

The invention relates to a high-pressure gas-heating device with a pressurized container (1) carrying a gas, a heating element (3) arranged in the pressurized container (1), and an insulation (2), which is arranged on the interior wall of the pressurized container (1). In particular, the invention relates to a high-pressure gas-heating device for a coating device for substrate materials with a pressurized container carrying a gas, a heating element arranged in the pressurized container, and an insulation.

During cold gas spraying or kinetic spraying, powder particles measuring 1 μm to 100 μm, and most recently particles measuring up to 250 μm, are accelerated in a gas stream to velocities of 200 m/s to 1600 m/s, without melting on or open, and sprayed onto the surface to be coated, the substrate. Only after a collision with the substrate does the plastic deformation accompanied by very high expansion rates increase the temperature on the colliding interfaces, causing the powder materials to become welded with the substrate and each other. However, a minimum collision rate must be exceeded to this end, the so-called critical velocity. The mechanism and quality of welding is comparable to explosive welding. Heating the process gas increases the sound velocity of the gas, and hence the flow rate of the gas in the die, and thus the particle velocity during a collision. In addition, the particle temperature increases when colliding with the process gas temperature. This results in a thermal softening and ductilizing the spraying material, which lowers the critical velocity of the colliding particles. The rise in process gas temperature hence increases both the particle velocity and particle temperature during collision. Both have a positive effect on the application efficiency and coating quality. The process gas temperature here always stays below the melting point of the used spraying material. Therefore, the cold gas spraying process involves the use of a "colder" gas by comparison to other spraying procedures in which the powder particles are melted by the gas. As is the case in spraying processes where auxiliary materials are melted open by hot gas, the gas must consequently be heated during cold gas spraying as well.

Gas with a high pressure is necessary for accelerating powder particles, in particular coarser particles 25 to 100 μm and larger, up to 250 μm thick. For heating purposes, the gas can be passed through a pressurized container incorporating a heating element. The pressurized container is hence exposed to high temperatures and pressures from the inside. If the temperature is allowed to directly act on the pressurized container, expensive high-temperature materials that are difficult to process must be used, or the size and necessary wall thickness make the pressurized container relatively heavy. A heater with such a pressurized container is difficult to operate owing to the high weight, and has a high thermal inertia. Heat dissipation via the pressure container leads to losses in heating capacity.

Known from DE 197 56 594 A1 is a device for coating substrate materials via thermal spraying, which can be used to spray powder particles. The substrate material coating device comprises a gas-heating device, which takes the form of an electrical resistance heater in one embodiment. The gas-heating device is here situated after a gas buffer container. Also known from the publication is to insulate lines carrying hot gas.

However, the disadvantage to this prior art is that the gas-heating device requires a pressurized container, which is relatively heavy due to its temperature resistance, and in cases when secured to a spray pistol, gets in the way during spray pistol operation. The necessary large material thickness of the pressurized container also makes it thermally inert.

FR 2568672 describes a gas heating method in which the gas is heated in a container with internal insulation. U.S. Pat. No. 5,963,709 discloses a wind heater, which has internal insulation, and incorporates a porous foamed ceramic in front and in back of the heating element, ensuring that the gas stays in the area of the heating element for a sufficient period of time.

BRIEF SUMMARY OF THE INVENTION

Therefore, the object of the invention is to provide a high-pressure gas-heating device that can operate at high pressures and high temperatures, and yet still be lightweight, and hence easy to handle. In particular, effective gas heating is to be possible even under a high pressure. Further, the object of the invention is to provide a high-pressure gas-heating device for a coating device for substrate materials.

This object is achieved by means of a high-pressure gas-heating device for a coating device having the features in independent claim 1, as well as a coating device according to claim 14. Advantageous further developments of the devices are described in the subclaims.

This object is achieved by means of a high-pressure gas-heating device that has a pressurized vessel that carries a gas, a heating element arranged in the pressurized container, and an insulation, which is arranged on the inner wall of the pressurized container, wherein the pressurized container is designed for pressures of 15 to 100 bar, and at least one flow distributor element is arranged in an inflow area of the pressurized container to distribute the inflowing gas over the entire width of the heating element.

The high-pressure gas-heating device emits gas with exiting gas temperatures of 100 to 1100° C., preferably of 700 to 900° C. In particular in the upper temperature range of the specified values, use can only be made of selected steels for a limited time, or of special high-temperature materials, since the material would otherwise soften, and creep would cause deformation, wherein most materials only exhibit low creep strength. Since the high-pressure gas-heating device heats gas under a pressure of 15 to 100 bar, in particular of 25 to 60 bar, a high level of energy is transferred to the wall of the pressurized container by the high-pressure gas. In the design of a high-pressure gas-heating device, the insulation situated on the inside diminishes the energy transfer to the wall of the pressurized container. Contact between the outer surface of the pressurized container and the environment and especially the heat dissipation means reduce the temperature of the pressurized container to 60% of the hot gas temperature with respect to the hot gas, preferably to less than 40%, and, given a proper layout, less than 20% of the hot gas temperature measured in ° C. In the latter case, temperatures of under 220° C. come about for the pressurized container, at which, for example, steel does not yet exhibit a significant diminishment in its strength. Therefore, the pressurized container can be designed with significantly less wall thickness, and is lighter, so that the high-pressure gas-heating device can also be integrated into a spray pistol. Due to the diminished heat emission to the pressurized container, the high-pressure gas-heating device is not thermally inert, and reacts quickly when changing the temperature of the gas. Further, the insulation on the inside of the pressurized container prevents thermal losses during continuous operation. To this end, it is advantageous if the used insulation material has a thermal conductivity of less than 4 W/(m*K), preferably of less than 2 W/(m*K), and if the insulation is designed in such a way that less than 300 W/($m^2$*K), preferably less than 150 W/($m^2$K), and especially preferred less than 75 W/($m^2$*K) be radiated to the pressurized container.

According to the invention, a flow distributor element is arranged in the inflow area of the pressurized container, which distributes the inflowing gas over the entire width of the heating element. Highly compressed gas has a high density and, assuming the same flow cross-section and same mass flow, a clearly lower flow rate in comparison to non-compressed gas. Therefore, the flow resistance is clearly lower, and there is no driving force for uniformly distributing the gas over the entire flow cross-section when using compressed gas under otherwise identical conditions. In order to ensure a uniform inflow toward the heating element, the gas stream is hence specifically distributed uniformly over the cross section of the pressurized container by the flow distributor element.

Therefore, in addition to the interior insulation, which is advantageous for achieving a compact structural design and low weight, at least one element is provided for flow distribution in order to achieve an effective heating of compressed gas. The flow distributor element is used for purposes of gas distribution, which must be done actively at the high pressures in the pressurized container to enable effective gas heating. To this end, the flow element must be designed in such a way as to experience only a slight pressure drop, if any at all. A pressure drop is disadvantageous for preferred use in a coating device, because the highest possible pressure is to be present in the spray piston in front of the die, so as to reach maximum gas velocities during relief in the die. As a result, the flow distributor element is more advantageously designed to keep the pressure drop down to less than one hundredth, preferably less than two hundredths, of the applied gas pressure. Further, the flow distributor element must distribute the gas very uniformly over the entire entry area of the gas heater, since a uniform flow through the heater is only achieved given a careful distribution of gas. In turn, this is necessary to enable an effective heat transfer from the heater to the gas, and achieve the desired high temperatures. Therefore, the high-pressure gas-heating device according to the invention makes it possible to effectively heat large quantities of gas to high temperatures of up to 900° C. or more at a high pressure of 15 to 100 bar. The device according to the invention is here very easy to operate and lightweight, so that it can be smoothly attached to a spray pistol, and move along with the spray pistol during thermal spraying. The device according to the invention yields power densities of 0.5 to 8 kW/kg, preferably 1 to 3 kW/kg, relative to the entire high-pressure gas heater, and power volumes of 3 to 30 kW/l, preferably 10 to 25 kW/l, relative to the inner volume of the pressurized container.

Special advantages are associated with forming the flow distributor element with a double cone or perforated disk, a lattice, guide sheets or divergent intake segment. These flow distributor elements can be arranged in the inflow area individually or in combination with two or more elements.

The heat dissipation means are preferably outer surface areas of the pressurized container that are directly in contact with the ambient air. Cooling grooves can be molded onto the outside surfaces.

Despite the high energy transfer resulting from highly pressurized gas, the insulation keeps losses owing to heat dissipation low, and ensures a low temperature of the pressurized container due already to the free surface areas on the outside of the pressurized container, which are in direct contact with the ambient air. However, should a pressurized container temperature arise that is still too high, cooling grooves, streaming gas or liquid, or both can also be used in combination for cooling the pressurized container.

The pressurized container temperature advantageously measures less than 600° C. The pressurized container can be made of steel and/or titanium or a titanium alloy, for example.

If the pressurized container temperature is reduced to below 600° C. by insulation and external heat dissipation, a pressurized container with walls that are distinctly less thick can be used during application of a high-temperature material. Pressurized containers made of steel, titanium or titanium alloy can also be sued. These materials exhibit no significant change in terms of strength at these temperatures. If the pressurized container temperature is reduced further to 400° C., a clear reduction in weight takes place.

In an advantageous embodiment, the pressurized container temperature measures less than 200° C. The pressurized container can be made of aluminum or aluminum alloys.

This enables a design made of light construction materials, in particular aluminum and aluminum alloys. Aluminum enables not just a lightweight, but also price-effective design.

In a favorable embodiment, the heating element consists of electric heating filaments. In particular, a filament heater is used.

Such a heating element in the form of a so-called filament heater is electrically heated, and advantageously does not generate any combustion residue. In a filament heater, the heating filaments are arranged in individual channels, wherein the gas to be heated passes through these channels. Finally, numerous channels taken together yield the filament heater.

In a favorable embodiment, the heating filaments have supply leads, which are heat resistance, and have heat-resistant passages through the wall of the pressurized container.

As a result, already heated gas can be supplied to the high-pressure gas-heating device, since the supply leads need not lie in a cold gas stream.

In a favorable embodiment, the device forms a replaceable unit with readily detachable terminals for gas supply and gas removal.

As a result, several devices can be connected in series, in particular if the gas supply terminal matches the gas removal terminal. This enables a flexible adjustment to the required capacity, and achievement of very high gas temperatures. Finally, replacement is made easy in the event of repairs.

The pressurized container can be designed for pressures of 25 to 60 bar, and the heating element can heat the gas up to 700° C. to 900° C.

The high-pressure gas-heating device advantageously then operates in the temperature and pressure ranges favorable for cold gas spraying. Higher gas temperatures increase the sound velocity of the gas, and hence the flow rate in a die, e.g., of a coating device. Particles are accelerated faster, and collide with a substrate to be coated at a higher speed. The particle temperature during collision also increases. The particle material is thermally softened and ductilized. Higher gas pressures yield a higher gas density in the gas flow, and thereby facilitate the acceleration of particles, in particular the acceleration of coarser particles. Coarser particles (diameter 25 to 100 μm and up to 250 μm) are very important in terms of being able to manufacture high-quality layers and achieve high application rates.

The object is also achieved by means of a coating device for substrate materials, in which at least one high-pressure gas-heating device is present. One or more of the high-pressure gas-heating devices can be arranged in or on a spray pistol, while others can be situated in a stationary section of the coating device, which are then connected in series with the spray pistol via a hot gas duct. In the stationary portion of the coating device, another gas heating method can be implemented in place of the high-pressure gas-heating device according to the invention, since weight and ease of use play only a subordinate role in the stationary portion.

This yields a high gas temperature, while still keeping the weight of the spray pistol down.

BRIEF DESCRIPTION OF THE DRAWING

An advantageous exemplary embodiment of the high-pressure gas-heating device according to the invention will be described based on the attached drawings. Shown on.

DETAILED DESCRIPTION OF THE INVENTION

Figure 1:
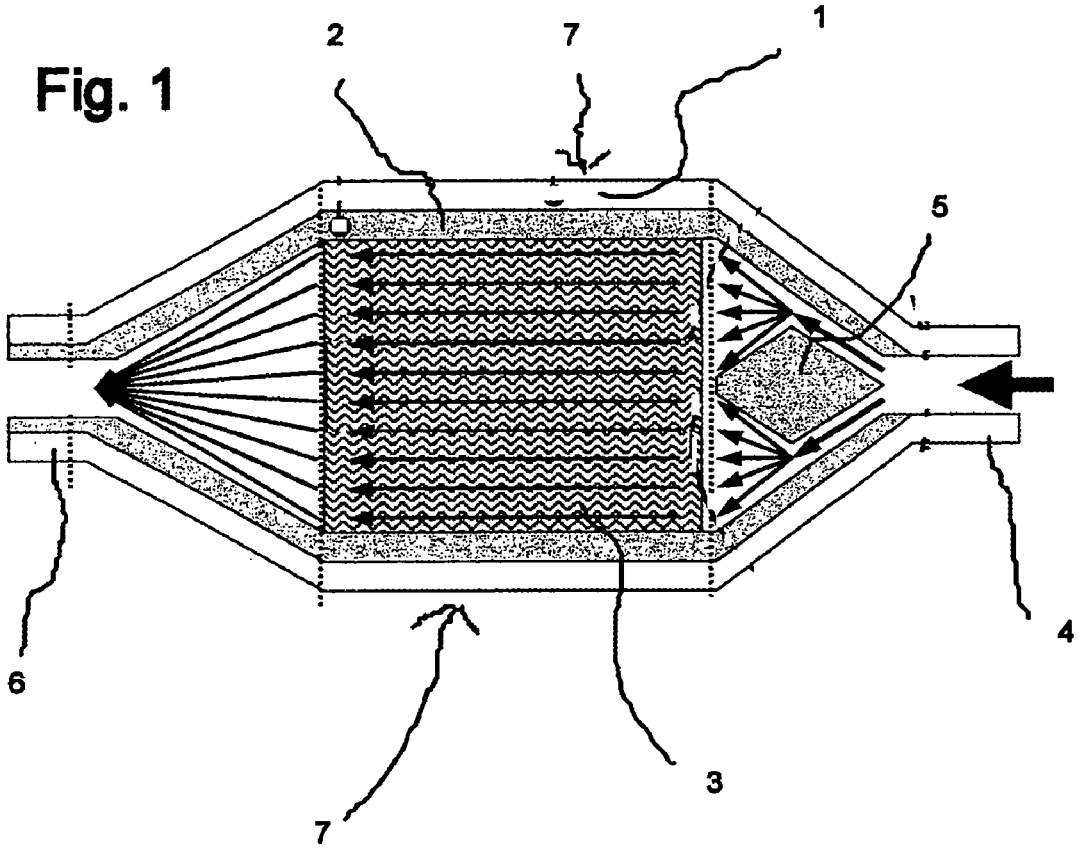
FIG. 1 is a diagrammatic view of a device according to the invention as a rotationally symmetrical component, longitudinal section.
Figure 2:
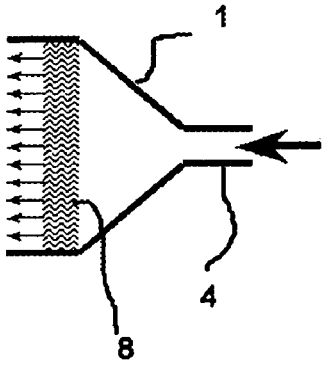
FIG. 2 to FIG. 6 are diagrammatic views of other embodiments of the flow distributor element of the device according to the invention on FIG. 1, longitudinal section.
Figure 3:
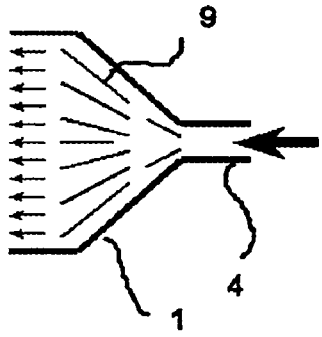
Figure 4:
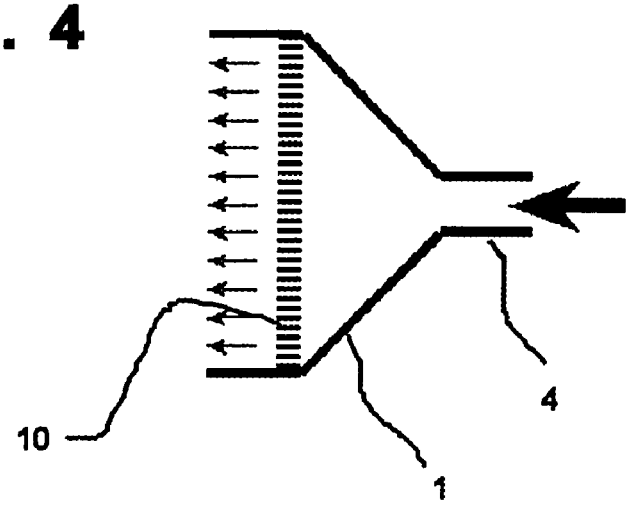
Figure 5:
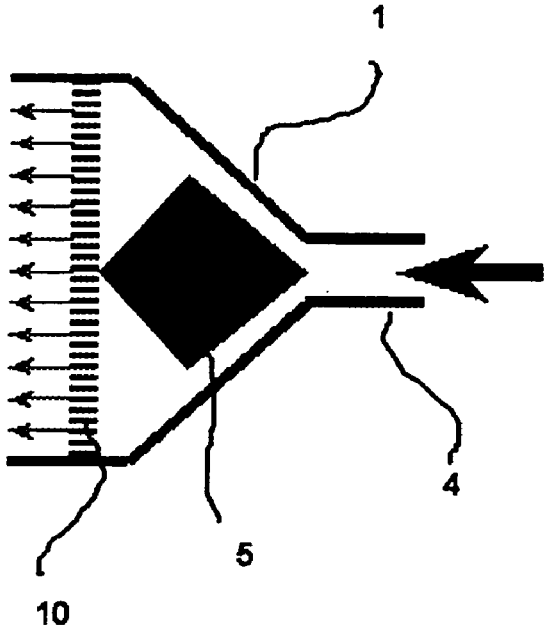

FIG. 1 diagrammatically shows a device according to the invention as a rotationally symmetrical component in longitudinal section, which in this example is used in a coating device for cold gas spraying. The interior of the pressurized container 1 has insulation 2. The pressurized container 1 incorporates a heating element 3, here in the form of a filament heater, which consists of a plurality of electrical heating filaments. The gas to be heated is supplied to the pressurized container 1 by way of a gas supply line 4. In the example in question, the pressurized container 1 is a rotationally symmetrical body, in which a double cone 5 lying in the gas stream denoted by the arrows represents the flow distributor element, which ensures a uniform distribution of gas over the cross-section of the heating element 3. The heated gas is routed out of the pressurized container 1 via a gas removal line 6. Outer surface areas 7 are in direct contact with the ambient air. The high-pressure gas-heating device according to the invention forms a standardized unit that can be easily replaced, e.g., in the event of repairs, or to arrange several in series. The heating element 3 can also be designed as a readily exchangeable heating cartridge. As a result, the heating element 3 can be easily replaced during repairs.

The gas flows through the pressurized container 1, wherein the double cone 5 distributes it uniformly over the cross-section of the heating element 3, as denoted by the arrows. The interior insulation 2 ensures that only a little thermal energy reaches the wall of the pressurized container 1. At the same time, heat from the pressurized container 1 is released to the environment via the outer surface areas 7, so that the pressurized container 1 is cooled, and has a significantly lower temperature than the heated gas. For this reason, the pressurized container 1 can have relatively thin walls and be lightweight in design. Given a change in the temperature to which the gas is to be heated, the device according to the invention reacts quickly and without delay. The insulation on the inside prevents the dimensions of the pressurized container from having a delaying effect.

The design of the high-pressure gas-heating device, e.g., insulation thickness, gas distribution, heating filament heating, makes it possible to achieve very high gas temperatures for a wide range of gas pressures while keeping a compact structural design and high power density.

Figure 6:
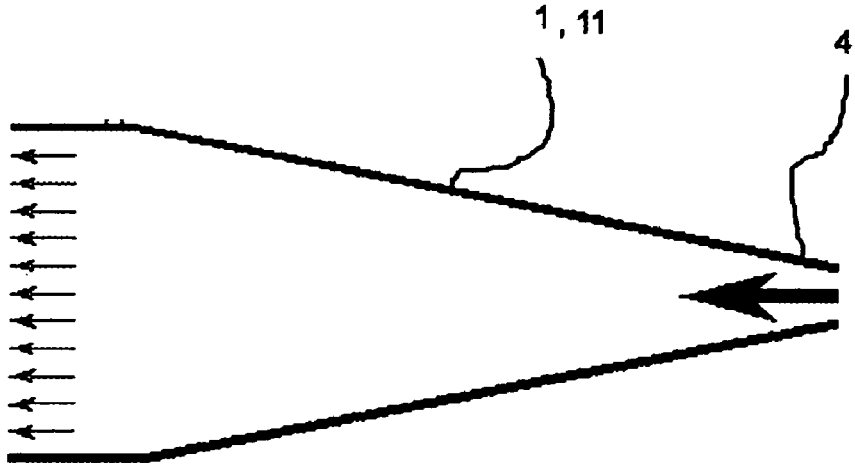

FIG. 2 to FIG. 6 provide diagrammatic views of other embodiments of the flow distributor element of the device according to the invention on FIG. 1, in longitudinal section. The front section of the pressure container 1 with the gas supply line 4 is shown. The flow distributor element on FIG. 2 consists of multiply arranged lattices 8, while the one on FIG. 3 consists of guide sheets 9. On FIG. 4, a perforated disk 10 is arranged in such a way as to uniformly distribute the gas, while on FIG. 5, the gas is distributed through a combination of double cone 5 and perforated disk 10. When using a perforated disk in conjunction with a filament heater, it is especially advantageous to arrange the holes in such a way that the holes narrow the access points to the individual channels of the filament heater, wherein one hole narrows access in one channel. Finally, FIG. 6 shows an embodiment in which the pressurized container 1 is designed in the area immediately following the gas supply line 4 as a divergent intake segment 11.

When using a double cone and another element, especially a pin diaphragm, for purposes of flow distribution, the double cone triggers a delay and a coarse distribution of the gas, while the other element effects the fine distribution of the gas in the heating element.

The high-pressure gas-heating device according to the invention can also be used in other areas, where highly pressurized gas must be heated, e.g., in the atomization of melts with hot gases. The high-pressure gas-heating device can also be used advantageously for pre-warming additional material or basic material while welding or soldering with electric arc, flame or laser. It is also possible to solder using the very gas stream that exits the device according to the invention. Another possible application involves the drying of hydrogen-sensitive materials, such as fine-grained structural steels or aluminum and aluminum alloys.

The high-pressure gas-heating device according to the invention enables a compact structural design with length to diameter ratios of between 1 and 5, and high power densities of 1 to 8 kW/kg, given a high performance volume of 5 to 25 kW/l, for example. Setting the device up as one unit makes it possible to quickly exchange a defective high-pressure gas-heating device. The device according to the invention makes it possible to achieve especially favorable collision temperatures for the particles sprayed during cold spraying of between 200 and 600° given a simultaneously high collision rate, since gas temperatures of 600 to 1100° C., in particular 800 to 1100° C., can be very flexibly selected.

REFERENCE LIST

1 Pressurized container
2 Insulation
3 Heating element
4 Gas supply line
5 Double cone
6 Gas removal
7 Outer surfaced area
8 Lattice
9 Guide sheet
10 Perforated disk

The invention claimed is:

1. A high-pressure gas-heating device comprising a pressurized container carrying a gas, a heating element arranged in the pressurized container wherein an insulation is arranged on the interior wall of the pressurized container, and means are provided for dissipating the heat of the pressurized container, so that the pressurized container has a lower temperature than the heated gas and a flow distributor element is arranged in an intake area of the pressurized container, which distributes the inflowing gas over the entire width of the heating element, said flow distributor element being designed to keep the pressure drop down to less than one hundredth of the applied gas pressure.

2. The device according to claim 1, characterized in that the heat dissipating means are outer surface areas of the pressurized container that are in direct contact with the ambient air.

3. The device according to claim 1, characterized in that the heating element heats the gas to 100° C. to 1100° C.

4. The device according to claim 1, characterized in that the pressurized container temperature measures less than 600° C.

5. The device according to claim 4, characterized in that the pressurized container is made from a metal selected from the group consisting of steel, titanium, titanium alloy, or mixtures thereof.

6. The device according to claim 4, characterized in that the pressurized container temperature measures less than 200° C.

7. The device according to claim 6, characterized in that the pressurized container is made of aluminum or an aluminum alloy.

8. The device according to claim 1, characterized in that the flow distributor element comprises a double cone.

9. The device according to claim 8, characterized in that the flow distributor element is selected from the group consisting of perforated disks, lattices, guide sheets or a divergent intake segment.

10. The device according to claim 1, characterized in that the heating element 3 comprises electrical heating filaments.

11. The device according to claim 10, characterized in that the heating filaments have supply leads, which are heat-resistant and have heat-resistant passages through the wall of the pressurized container.

12. The device according to claim 1, characterized in that the device forms a replaceable unit with readily detachable terminals for gas supply and gas removal.

13. The device according to claim 1, characterized in that the pressurized container is designed for pressures of 15 to 100 bar.

14. A coating device for substrate materials, characterized in that at least one high-pressure gas-heating device according to claim 1 is present.

15. The coating device according to claim 14, characterized in that at least one additional high-pressure gas-heating device is arranged in a stationary section of the coating device, and situated in series in a gas supply with the high-pressure gas-heating device.

16. The device according to claim 1, characterized in that the heating element heats the gas to 700° C. to 900° C.

17. The device according to claim 1, characterized in that the pressurized container is designed for pressures of 25 to 60 bar.

18. The device according to claim 1, characterized in that the pressure drop is kept down to less than two hundredths of the applied gas pressure.

* * * * *